US010967661B2

(12) United States Patent
Svensson et al.

(10) Patent No.: US 10,967,661 B2
(45) Date of Patent: Apr. 6, 2021

(54) PRINTHEAD GUARD

(71) Applicant: ENTRUST CORPORATION, Shakopee, MN (US)

(72) Inventors: Scott Svensson, Shakopee, MN (US); Bryan Hoeve, Shakopee, MN (US); Donald Galles, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 0 days.

(21) Appl. No.: 16/567,734

(22) Filed: Sep. 11, 2019

(65) Prior Publication Data

US 2020/0079124 A1 Mar. 12, 2020

Related U.S. Application Data

(60) Provisional application No. 62/729,755, filed on Sep. 11, 2018.

(51) Int. Cl.
*B41J 29/12* (2006.01)
*B41J 3/28* (2006.01)
(Continued)

(52) U.S. Cl.
CPC ..... *B41J 29/12* (2013.01); *B41J 2/32* (2013.01); *B41J 3/28* (2013.01); *B41J 3/387* (2013.01);
(Continued)

(58) Field of Classification Search
CPC ..... B41J 2/32; B41J 3/28; B41J 3/387; B41J 25/304; B41J 13/12; B41J 29/12; B41J 29/13
See application file for complete search history.

(56) References Cited

U.S. PATENT DOCUMENTS 4,825,054 A 4/1989 Rust et al.
4,995,501 A 2/1991 Lundstrom et al.
(Continued)

FOREIGN PATENT DOCUMENTS

JP 2007-216588 A 8/2007

OTHER PUBLICATIONS

International Search Report and Written Opinion, International Patent Application No. PCT/IB2019/057669, Sep. 11, 2019 (11 pages).

*Primary Examiner* — Anh T Vo
(74) *Attorney, Agent, or Firm* — Harme, Schumann, Mueller & Larson, P.C.

(57) ABSTRACT

A plastic card printer that is provided with a printhead guard that is movable between a covering position, where the printhead guard covers one or more sensitive portions of a printhead of the plastic card printer, and a non-covering position, where the printhead guard does not cover the one or more sensitive portions of the printhead thereby allowing the printhead to perform a printing function on a plastic card. The printhead guard can be at the covering position when the printhead is at a non-printing position, for example during servicing of the card printer, to protect the one or more sensitive elements when the printhead is at the non-printing position, and the printhead guard can be at the non-covering position when the printhead is at a printing position where the printhead is ready to perform printing.

12 Claims, 8 Drawing Sheets

(51) Int. Cl.

| | |
|---|---|
| ***B41J 13/12*** | (2006.01) |
| ***B41J 3/38*** | (2006.01) |
| ***B41J 25/304*** | (2006.01) |
| ***B41J 29/13*** | (2006.01) |
| ***B41J 2/32*** | (2006.01) |

(52) U.S. Cl.
CPC ..... *B41J 13/12* (2013.01); *B41J 25/304* (2013.01); *B41J 29/13* (2013.01)

(56) References Cited

U.S. PATENT DOCUMENTS

| | | | | |
|---|---|---|---|---|
| 5,266,781 | A | 11/1993 | Warwick et al. | |
| 5,570,123 | A | 10/1996 | Almonte | |
| 5,837,991 | A | 11/1998 | LaManna et al. | |
| 6,131,817 | A | 10/2000 | Miller | |
| 6,443,645 | B1 * | 9/2002 | Takei | B41J 11/48 400/595 |
| 6,783,067 | B2 | 8/2004 | Kreuter et al. | |
| 6,902,107 | B2 | 6/2005 | Shay et al. | |
| 7,398,972 | B2 | 7/2008 | Ischuller et al. | |
| 7,434,728 | B2 | 10/2008 | Paulson et al. | |
| 8,303,201 | B2 * | 11/2012 | Kaneoya | B41J 13/12 400/701 |
| 9,925,778 | B2 * | 3/2018 | Harada | B41J 2/16508 |
| 2004/0008235 | A1 | 1/2004 | Keyes et al. | |
| 2004/0109715 | A1 | 6/2004 | Meier et al. | |
| 2007/0187870 | A1 | 8/2007 | Lundstrom et al. | |
| 2011/0050799 | A1 * | 3/2011 | Nishida | B41J 2/16511 347/30 |
| 2015/0239249 | A1 | 8/2015 | Plummer et al. | |

* cited by examiner

PRINTHEAD GUARD

FIELD

This disclosure describes plastic card printers that are used to print on plastic cards to produce personalized plastic cards such as financial cards including credit and debit cards, identification cards, driver's licenses, and other plastic cards.

BACKGROUND

The use of plastic card printers to print on plastic cards is well known. One example of a plastic card printer is disclosed in U.S. Pat. No. 7,398,972. The type of plastic card printer described in U.S. Pat. No. 7,398,972 is often referred to as a desktop plastic card printer since the plastic card printer has a size small enough to allow the printer to reside on a desktop or table. The plastic card printer may perform only printing, or in some instances may include other functionality such as laminating, magnetic stripe encoding, programming of a chip embedded in the card, card flipping or duplexing, and the like.

SUMMARY

A plastic card printer is described herein that is provided with a printhead guard that is movable between a covering position, where the printhead guard covers one or more sensitive portions of a printhead of the plastic card printer, and a non-covering position, where the printhead guard does not cover the one or more sensitive portions of the printhead thereby allowing the printhead to perform a printing function on a plastic card. The printhead guard can be at the covering position when the printhead is at a non-printing position, for example during servicing of the card printer, to protect the one or more sensitive elements from damage when the printhead is at the non-printing position, and the printhead guard can be at the non-covering position when the printhead is at a printing position where the printhead is ready to perform printing.

In one embodiment, the printhead can be a thermal printhead with a dot row formed by a plurality of individual resistive elements, and the printhead prints using a replaceable print ribbon. The print ribbon needs occasional replacement, and during replacement of the print ribbon the printhead may be moved to the non-printing position whereby the dot row may be exposed and thereby susceptible to damage. The printhead guard described herein covers the dot row when the printhead guard is at the covering position, and once ribbon replacement is completed and the printhead is returned back to the printing position, the printhead guard is moved to the non-covering position to uncover the dot row to enable printing to occur.

The printhead may be moved to the non-printing position, thereby exposing the sensitive elements thereof to possible damage, for reasons other than ribbon replacement. Regardless of the reason for the printhead being at the non-printing position, the printhead guard described herein covers the sensitive elements of the printhead when the printhead is at the non-printing position to protect the sensitive elements from damage, with the printhead guard returning to the non-covering position to uncover the sensitive elements to enable printing to occur when the printhead is returned to the printing position.

The sensitive elements of the printhead described herein can be any portion of the printhead that one may wish to protect from being damaged when the printhead is at the non-printing position. In the case of a thermal printhead, the sensitive elements may be the resistive elements in the dot row. In the case of a drop-on-demand printhead, the sensitive element could be a nozzle plate.

The printhead guard may cover all of the sensitive element(s) or only a portion of the sensitive element(s). In one embodiment, when the printhead guard is at the covering position, the printhead guard is not in direct physical contact with the sensitive element(s) of the printhead so that the printhead guard cannot damage the sensitive element(s) through direct physical contact. In addition, in the covering position, the printhead guard should be configured so that casual contact with the printhead guard by the person conducting maintenance on the card printer does not cause the printhead guard to move into direct physical contact with the sensitive element(s) and thereby possibly damage the sensitive element(s).

In one embodiment described herein, a plastic card printer includes a card input through which a plastic card is input for printing, and a printhead that is configured to print onto the plastic card. The printhead is movable between a printing position at which the printhead can print onto the plastic card and a non-printing position at which the printhead cannot print onto the plastic card. A printhead guard is associated with the printhead, and the printhead guard is movable between a covering position where the printhead guard covers the printhead and a non-covering position where the printhead guard does not cover the printhead. The printhead guard is at the covering position when the printhead is at the non-printing position, and the printhead guard is at the non-covering position when the printhead is at the printing position.

In another embodiment described herein, a plastic card printer includes a printer housing that has a panel that is pivotable between a closed position and an open position. A card input hopper can be attached to the printer housing, where the card input hopper is configured to hold a plurality of plastic cards to be printed on. A print station is within the printer housing at which a plastic card fed from the card input hopper is printed on, where the print station includes a thermal printhead with a plurality of resistive elements, and a removable print ribbon. The thermal printhead can be fixed to and moveable with the panel for movement between a printing position at which the thermal printhead can print onto the plastic card and a non-printing position at which the thermal printhead cannot print onto the plastic card. The thermal printhead is at the printing position when the panel is at the closed position and the thermal printhead is at the non-printing position when the panel is at the open position. The card printer also includes a card transport mechanism that transports the plastic card from the card input hopper to the print station for printing on the plastic card by the thermal printhead. In addition, a printhead guard is associated with the thermal printhead, where the printhead guard is movable between a covering position where the printhead guard covers the plurality of resistive elements of the thermal printhead and a non-covering position where the printhead guard does not cover the plurality of resistive elements of the thermal printhead. The printhead guard is at the covering position when the thermal printhead is at the non-printing position, and the printhead guard is at the non-covering position when the thermal printhead is at the printing position.

DRAWINGS

DETAILED DESCRIPTION

Figure 1:
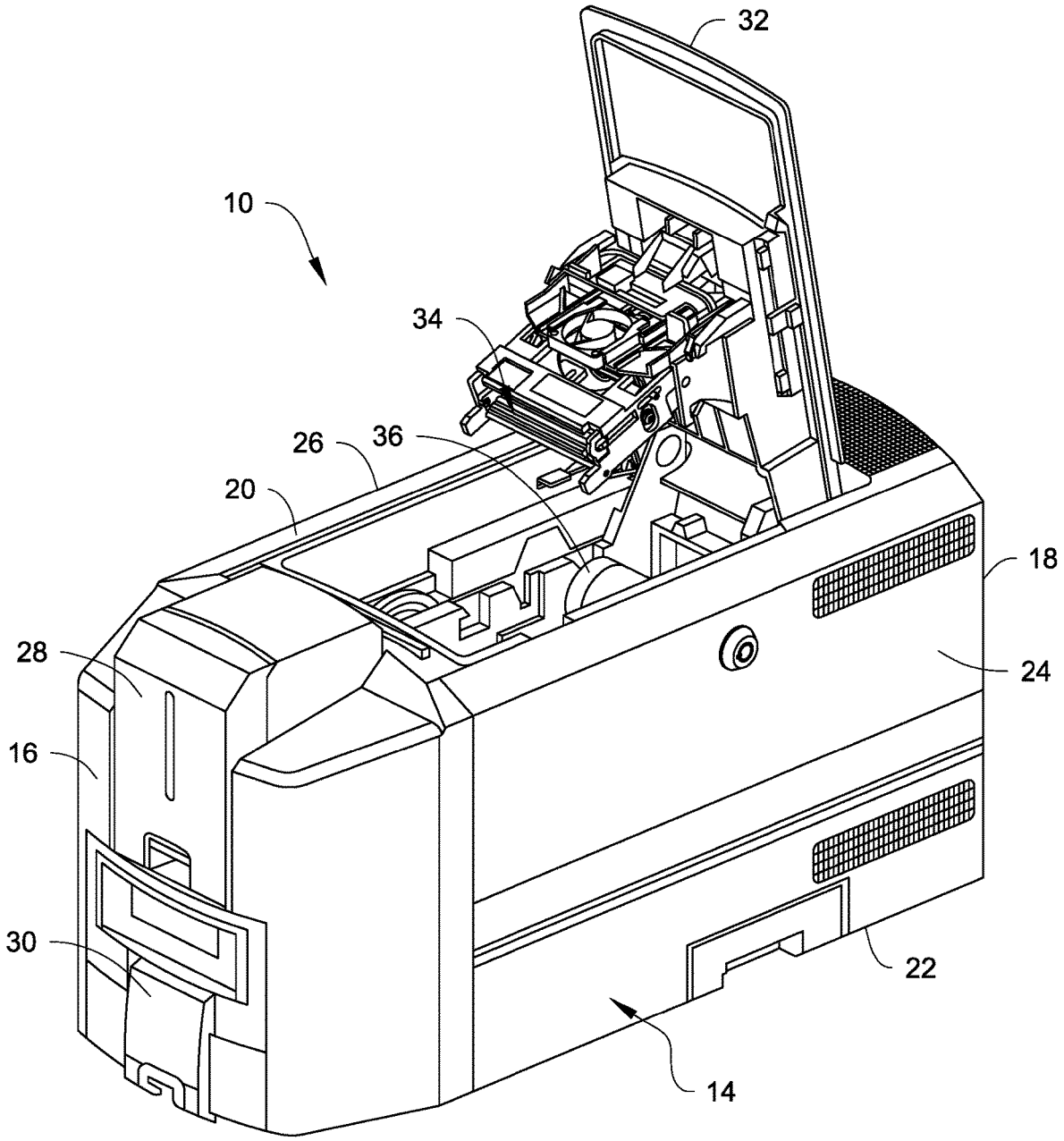
FIG. 1 illustrates an example of a plastic card printer with a printhead in a non-printing position and a printhead guard described herein at a covering position over sensitive element(s) of the printhead.

Referring to FIG. 1, a plastic card printer 10 that incorporates a printhead guard 12 (FIGS. 3-8) described herein is illustrated. The card printer 10 is configured to personalize a plastic card that is input into the card printer 10 and thereafter output the personalized plastic card. The term "plastic card" as used herein encompasses cards that are completely or substantially plastic, as well as cards that have non-plastic or composite components and cards having other formulations that function like the card types indicated above. Cards that are encompassed by the term "plastic cards" often bear printed personalized data unique to or assigned specifically to the cardholder, such as the name of the cardholder, an account number, an image of the face of the cardholder, and other data. In some embodiments, the cards can include a magnetic stripe and/or integrated circuit chip that holds/stores personalized data unique to or assigned specifically to the cardholder. Examples of plastic cards include, but are not limited to, financial (e.g., credit, debit, or the like) cards, driver's licenses, national identification cards, business identification cards, gift cards, and other plastic or composite cards which bear personalized data unique to or assigned specifically to the cardholder and/or which bear other card information.

To help simplify the description, the card printer 10 is illustrated as, and will be described as being, a desktop plastic card printer that has a size small enough to allow the card printer 10 to reside on a desktop or table and that is designed to personalize plastic cards in relatively small volumes, for example measured in tens or low hundreds per hour. An example of a desktop plastic card printer is the CD800 Card Printer available from Entrust Datacard Corporation of Shakopee, Minn. Additional examples of desktop printers are disclosed in U.S. Pat. Nos. 7,434,728 and 7,398,972, each of which is incorporated herein by reference in its entirety.

In other embodiments, the printhead guard 12 described herein can be employed to cover a sensitive element(s) of a printhead used in a large volume batch plastic card production machine, often configured with multiple processing stations or modules, typically referred to as a central issuance system, that processes multiple plastic cards, at the same time and is designed to personalize plastic cards in relatively large volumes, for example measured in the high hundreds or even thousands per hour. An example of a central issuance system is the MX or MPR-lines of central issuance systems available from Entrust Datacard Corporation of Shakopee, Minn. Additional examples of central issuance systems are disclosed in U.S. Pat. Nos. 4,825,054, 5,266,781, 6,783,067, and 6,902,107, all of which are incorporated herein by reference in their entirety.

The plastic card printer 10 may be configured to perform only printing. In some embodiments, the card printer 10 may also be configured to include other functionality such as laminating the card, reading and/or writing data on a magnetic stripe on the card, programming a chip on the card, card flipping or duplexing, and other functions known in the art of card personalization.

Figure 2:
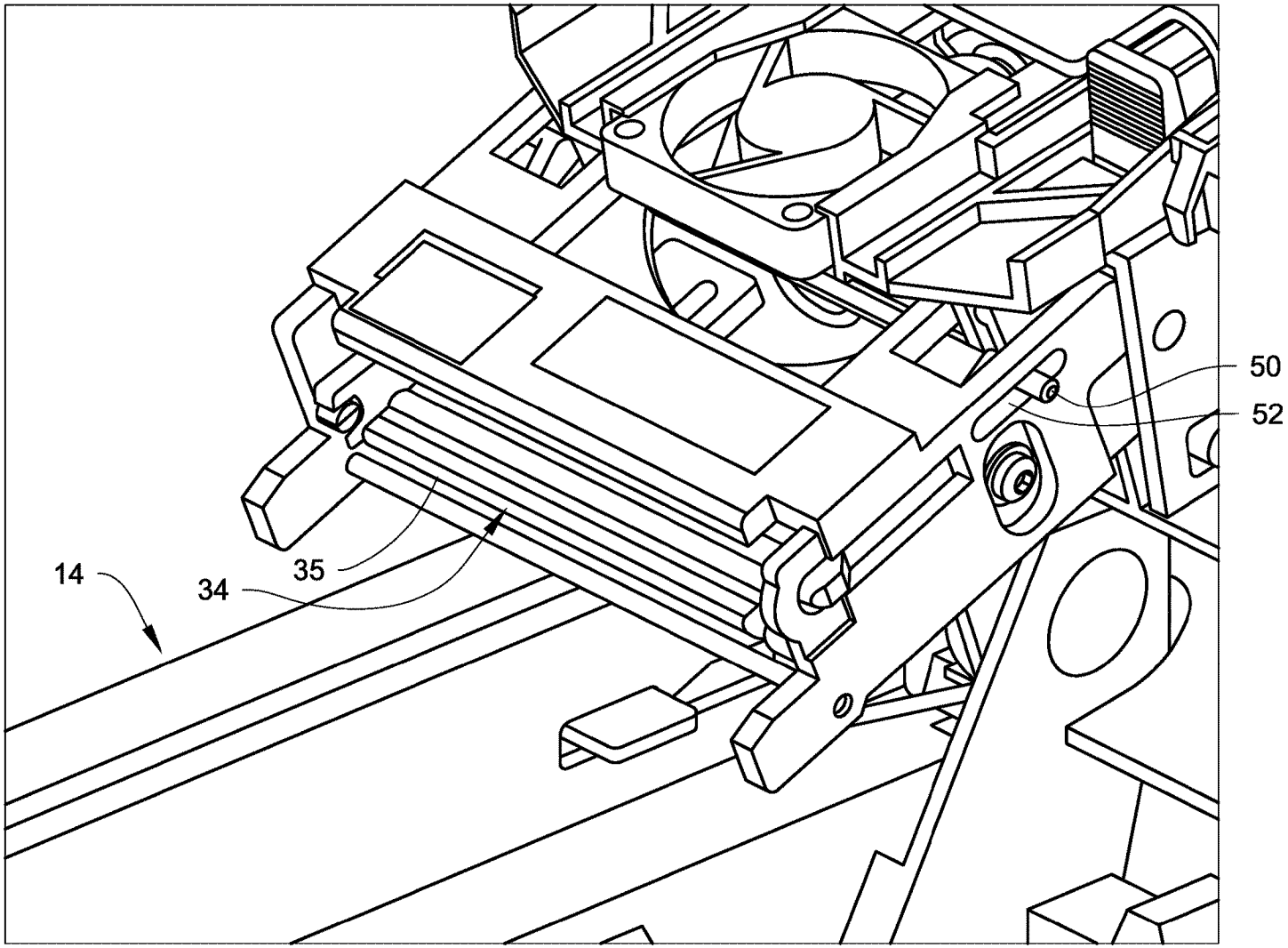
FIG. 2 is a close-up view of the printhead of the plastic card printer of FIG. 1 depicting a sensitive element(s) of the printhead with the printhead guard in a non-covering position for sake of clarity.

With reference to FIGS. 1 and 2, the plastic card printer 10 includes a printer housing 14 having a front 16, a back 18, a top 20, a bottom 22, a first side 24 and a second side 26. The card printer 10 further includes a card input hopper 28 that holds a plurality of plastic cards waiting to be personalized. The cards are individually fed one-by-one from the card input hopper 28 through a card input into the card printer to a print station for printing on the plastic cards and possibly followed by other card processing operations. In the illustrated example, the input hopper 28 is illustrated as being at the front 16 of the card printer 10. However, the input hopper 28 can be at other locations on the card printer 10, for example at the back 18.

The card printer 10 further includes a card outlet 30 through which personalized cards are output. The card outlet 30 can be a simple outlet slot in the housing 14 or the card outlet 30 can be an output hopper that is configured to hold a plurality of personalized cards. In the illustrated example, the card outlet 30 is illustrated as being at the front 16 of the card printer 10. However, the card outlet 30 can be at other locations on the card printer 10, for example at the back 18.

A panel 32 is disposed at the top 20 of the printer housing 14 that is pivotable between a closed position (not shown) and an open position (FIG. 1). In the illustrated embodiment, the panel 32 can form a portion of the top 20 of the printer housing 14. The pivoting of the panel 32 controls access to a print station of the card printer 10, with the panel 32 at the closed position preventing access to the print station so that the card printer 10 is ready for use, and the panel 32 at the open position allowing access to the print station, for example for maintenance or other purposes. The print station includes a printhead 34 that is configured to perform printing. The printhead 34 is fixed to and is moveable with the panel 32 for movement between a printing position (corresponding to the closed position of the panel 32) at which the printhead 34 can print onto the plastic card at the print station and a non-printing position (corresponding to the open position of the panel 32 in FIG. 1) at which the printhead 34 cannot print onto the plastic card. An example a card printer with a pivoting panel with a printhead moveable with the panel is the CD800 Card Printer available from Entrust Datacard Corporation of Shakopee, Minn.

The printhead 34 can have any configuration that allows the printhead 34 to perform printing on the plastic card. For example, the printhead 34 can be configured as a thermal printhead with a dot row 35 (see FIGS. 2 and 4) formed by a plurality of resistive elements. In other embodiments, the printhead 34 can be a drop-on-demand printhead, a dot matrix printhead, or any other printhead that is suitable for printing onto plastic cards or other substrates to be printed on.

In the case of the printhead 34 being a thermal printhead, the opening of the panel 32 to the open position, and movement of the printhead 34 therewith to the non-printing position, provides access to a replaceable print ribbon supply 36 (only a portion of which is visible in FIG. 1) of the print station, thereby allowing removal and replacement of the print ribbon supply 36. The print ribbon supply 36 includes a print ribbon containing, for example, a single dye color for monochromatic printing or multiple dye colors for multicolor printing. For example, the print ribbon can be a CMYK-ribbon containing a plurality of sequential and repeating cyan (C), magenta (M), yellow (Y) and black (K) dye panels. However, many other print ribbons and other types of panels on the ribbon are possible.

The card printer 10 also includes a card transport mechanism (not illustrated) that transports the plastic card within the card printer 10, for example from the card input hopper 28 to the print station for printing on the plastic card, and from the print station or other processing station to the card outlet 30. The plastic card can be transported through the card printer 10 using any suitable mechanical card transport mechanism(s) that are well known in the art of card handling within card printers. Examples of card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms.

Without the printhead guard 12 described herein, when the panel 32 is at the open position and the printhead 34 is at the non-printing position, the dot row 35 is exposed to possible damage, for example during replacement of the ribbon supply 36. However, the printhead guard 12 described herein is configured to be movable between a covering position (FIG. 5), where the printhead guard 12 covers the dot row 35 of the printhead 34 thereby protecting the dot row 35 from damage, and a non-covering position (FIG. 4) where the printhead guard 12 does not cover the dot row 35 of the printhead 34 thereby allowing the printhead 34 to perform a printing function on a plastic card. The printhead guard 12 is at the covering position when the printhead 34 is at the non-printing position, and the printhead guard 12 is at the non-covering position when the printhead 34 is at a printing position where the printhead 34 is ready to perform printing. The dot row 35 is just one example of a sensitive element of a printhead that one way wish to cover using the printhead guard 12. If the printhead 34 were of a type other than a thermal printhead, for example a drop-on-demand printhead, the printhead guard 12 may be used to cover the nozzle plate of the drop-on-demand printhead or other sensitive element of another type of printhead. The printhead guard 12 can be used to cover any sensitive portion of any type of printhead.

The printhead guard 12 is biased toward the covering position so that the printhead guard 12 automatically moves from the non-covering position to the covering position as the panel 32 pivots open and moves the printhead 34 from the printing position to the non-printing position. In addition, the printhead guard 12 is automatically actuated from the covering position to the non-covering position as the printhead 34 is moved from the non-printing position to the printing position. The term "automatically" refers to movement that occurs without direct manual actuation by a user. A user opening the panel 32 and closing the panel 32, which results in movement of the printhead guard 12, is not considered direct manual activation.

An example of the printhead guard 12 is illustrated in FIGS. 3-5 and 7-8. In this example, the printhead guard 12 includes a generally L-shaped cover 40 with a base 42 and a leg 44. The cover 40 is pivotable between the non-covering position (shown in FIG. 4) where the base 42 is not disposed over the dot row 35 and the covering position (shown in FIG. 5) where the base 42 is disposed over the dot row 35 thereby protecting the dot row 35 from damage.

Figure 3:
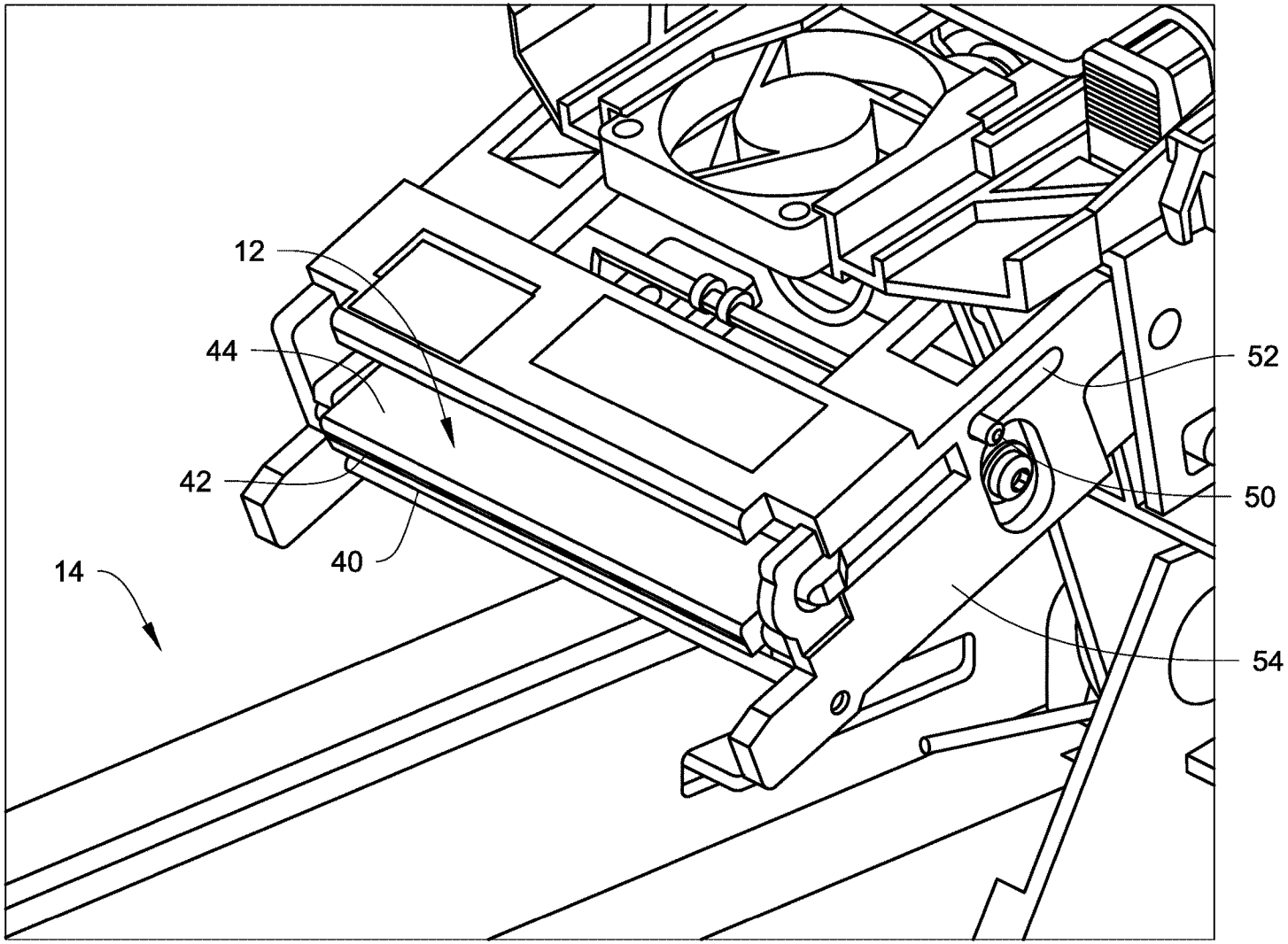
FIG. 3 is a close-up view similar to FIG. 2 but with the printhead guard in a covering position covering the sensitive element(s).
Figure 4:
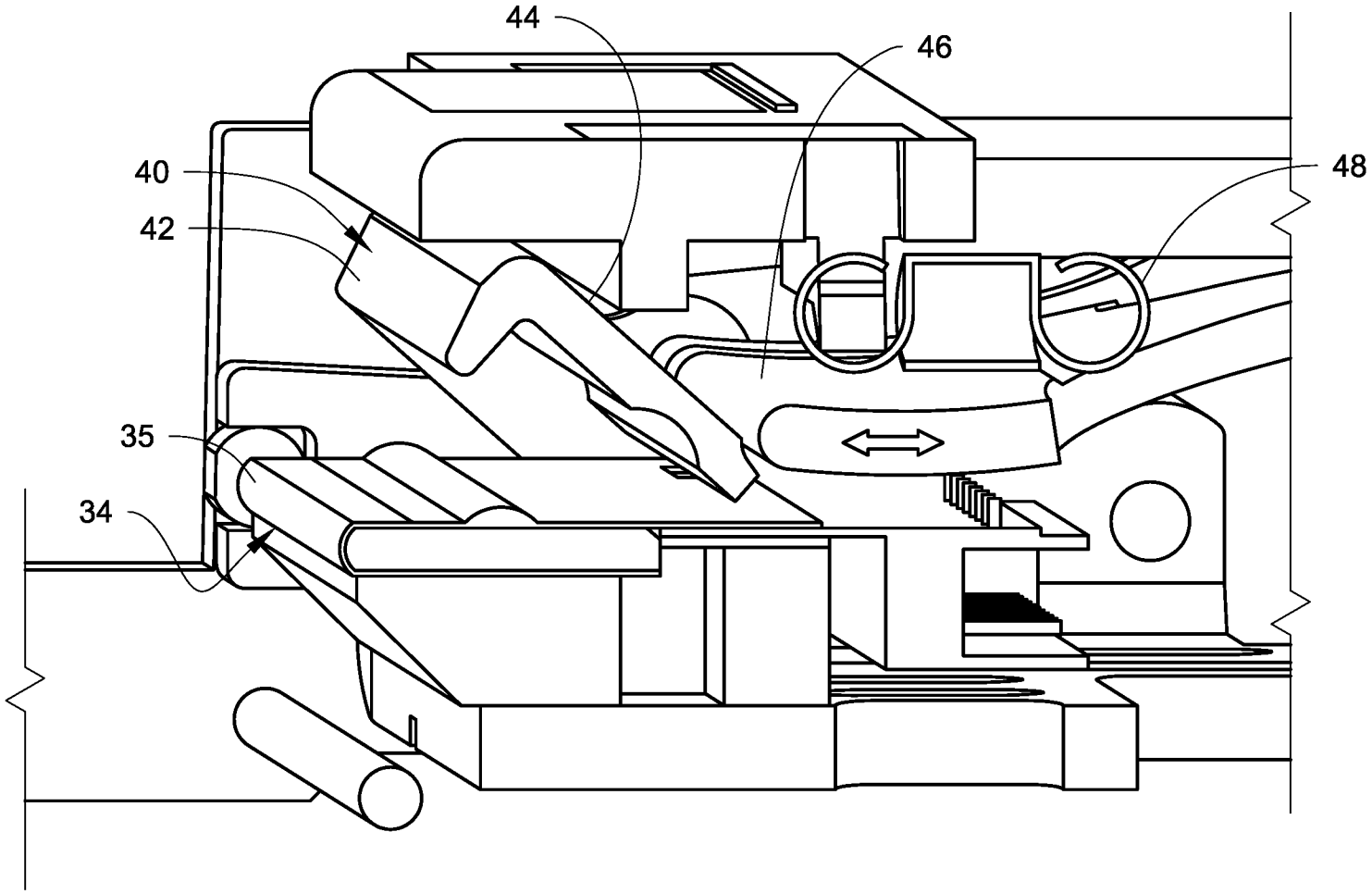
FIG. 4 is a cross-sectional view depicting details of the printhead guard and the printhead, with the printhead guard at the non-covering position.
Figure 5:
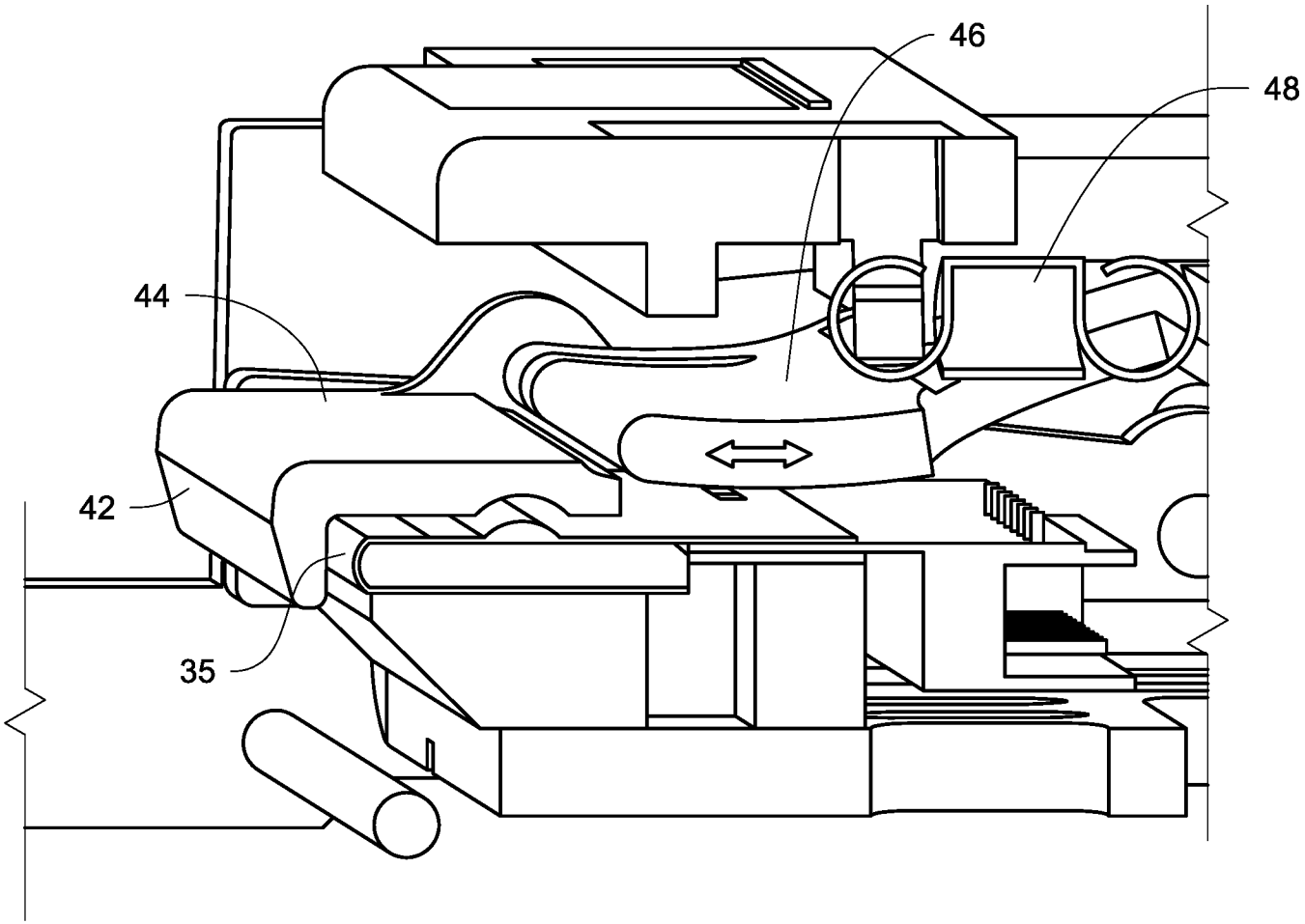
FIG. 5 is a cross-sectional view similar to FIG. 4 but with the printhead guard at the covering position.

The leg 44 of the cover 40 is connected to a slide 46 that is slideable back and forth in directions toward and away from the printhead 34 as indicated by the arrows in FIGS. 4 and 5. The slide 46 is biased by a spring 48 or other biasing mechanism in a direction toward the printhead 34. In addition, a pair of pins 50 (only one pin 50 being visible in FIG. 3; both pins 50 are visible in FIG. 7) are connected to the slide 46 and protrude through respective elongated slots 52 formed in a housing 54 that houses the printhead 34. The housing 54 is shown in phantom line in FIG. 7 to better illustrate details of the printhead guard 12 and the slide 46.

Figure 6:
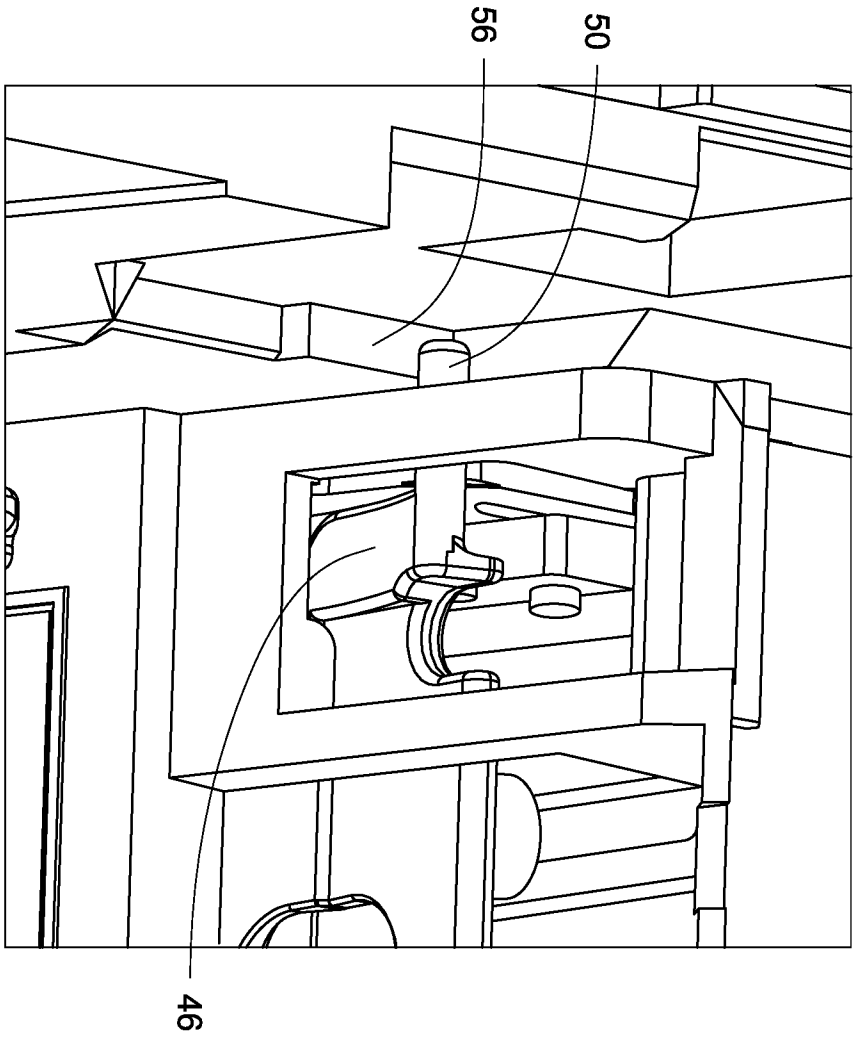
FIG. 6 is a view of a portion of the interior of the card printer housing showing how the pins on the slide are actuated.
Figure 7:
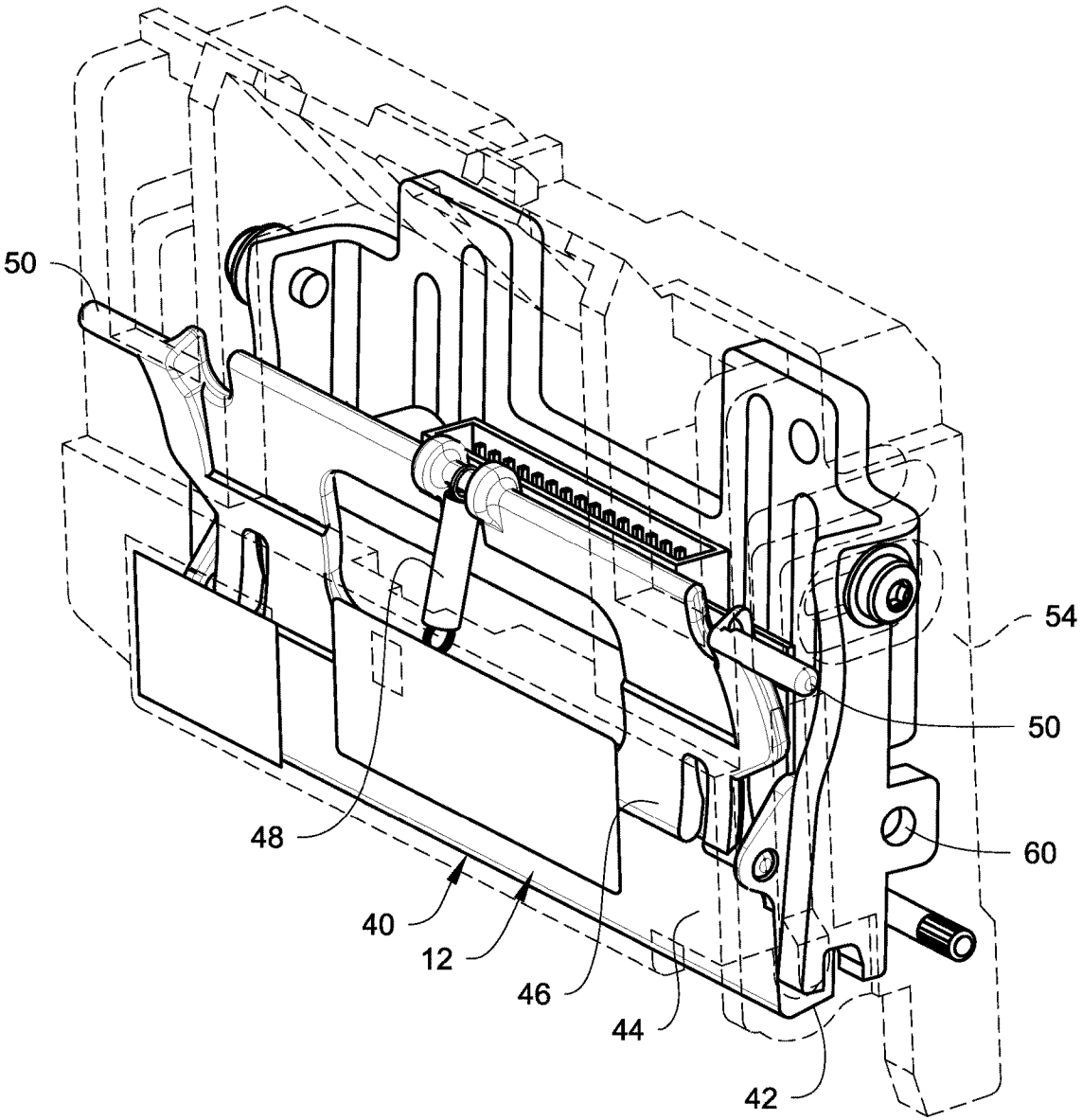
FIG. 7 is a perspective view of the slide and the printhead guard.
Figure 8:
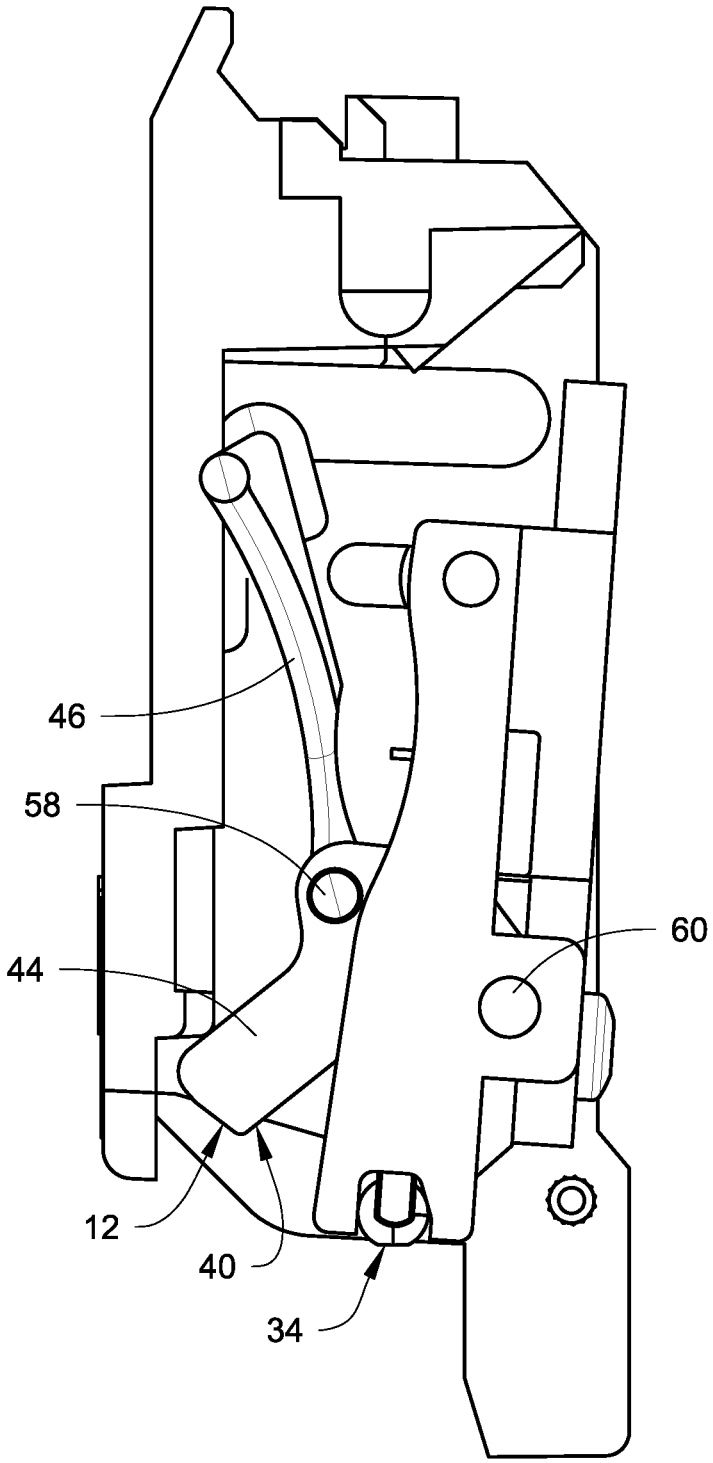
FIG. 8 is a side view of the slide and the printhead guard.

FIGS. 3 and 7 show the pins 50 at the end of the slots 52 closest to the printhead 34 due to the slide 46 being biased by the spring 48 so that the cover 40 is at the covering position over the dot row 35 of the printhead. When the panel 32 is moved to the closed position, which moves the printhead 34 to the printing position, the pins 50 engage structures 56 such as ledges (see FIG. 6) formed on opposite interior walls inside the printer housing 14 which forces the pins 50 upwards in the slots 52 thereby forcing the slide 46 away from the printhead 34. Only one ledge is illustrated in FIG. 6, it being understood that a similar ledge is present on the opposite wall of the printer housing 14 to be engaged by the other pin 50. Referring to FIG. 8, the end of the slide 46 is pivotally attached to the cover 40 by a pivot 58, and the cover 40 is also pivotally attached to the card printer 10 by a pivot 60 that is spaced from the pivot 58. As the slide 46 is forced upward and away from the printhead 34, the cover 40 pivots about the pivot 60 thereby retracting the cover 40 to the non-covering position in FIGS. 4 and 8.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plastic card printer, comprising:

a card input through which a plastic card is input for printing;

a printhead that is configured to print onto the plastic card, the printhead is movable between a printing position at which the printhead can print onto the plastic card and a non-printing position at which the printhead cannot print onto the plastic card;

a printhead guard associated with the printhead, the printhead guard is movable relative to the printhead between a covering position where the printhead guard covers the printhead and a non-covering position where the printhead guard does not cover the printhead; and wherein the printhead guard is at the covering position when the printhead is at the non-printing position, and the printhead guard is at the non-covering position when the printhead is at the printing position.

2. The plastic card printer of claim 1, further comprising a card transport mechanism that transports the plastic card from the card input to the printhead for printing on the plastic card.

3. The plastic card printer of claim 1, wherein the printhead guard is automatically movable from the non-covering position to the covering position as the printhead is moved from the printing position to the non-printing position, and the printhead guard is automatically movable from the covering position to the non-covering position as the printhead is moved from the non-printing position to the printing position.

4. The plastic card printer of claim 1, wherein the printhead is a thermal printhead with a dot row; and further comprising a print ribbon associated with the printhead.

5. The plastic card printer of claim 4, wherein the print ribbon comprises a plurality of cyan, magenta, yellow and black panels.

6. The plastic card printer of claim 4, further comprising a printer housing having a panel that is pivotable between a closed position and an open position; and the printhead is fixed to and movable with the panel whereby the printhead is at the printing position when the panel is at the closed position and the printhead is at the non-printing position when the panel is at the open position.

7. A plastic card printer, comprising:

a printer housing that has a panel that is pivotable between a closed position and an open position;

a card input hopper attached to the printer housing, the card input hopper is configured to hold a plurality of plastic cards to be printed on;

a print station within the printer housing at which a plastic card fed from the card input hopper is printed on, the print station including a thermal printhead with a dot row, and a removable print ribbon;

the thermal printhead is fixed to and moveable with the panel for movement between a printing position at which the thermal printhead can print onto the plastic card and a non-printing position at which the thermal printhead cannot print onto the plastic card; the thermal printhead is at the printing position when the panel is at the closed position and the thermal printhead is at the non-printing position when the panel is at the open position;

a printhead guard associated with the thermal printhead, the printhead guard is movable relative to the printhead between a covering position where the printhead guard covers the dot row of the thermal printhead and a non-covering position where the printhead guard does not cover the dot row of the thermal printhead; and wherein the printhead guard is at the covering position when the thermal printhead is at the non-printing position, and the printhead guard is at the non-covering position when the thermal printhead is at the printing position.

8. The plastic card printer of claim 7, wherein the printhead guard is automatically movable from the non-covering position to the covering position as the thermal printhead is moved from the printing position to the non-printing position, and the printhead guard is automatically movable from the covering position to the non-covering position as the thermal printhead is moved from the non-printing position to the printing position.

9. The plastic card printer of claim 7, wherein the print ribbon comprises a plurality of cyan, magenta, yellow and black panels.

10. The plastic card printer of claim 7, wherein the printer housing includes a front, back, top, bottom, first side and second side; and the panel is disposed at the top of the printer housing.

11. The plastic card printer of claim 10, wherein the card input hopper is disposed at the front of the printer housing.

12. The plastic card printer of claim 11, wherein the printer housing further includes a card outlet that is disposed at the front.

* * * * *